US011043771B2

(12) United States Patent
Shinoda

(10) Patent No.: US 11,043,771 B2
(45) Date of Patent: Jun. 22, 2021

(54) ELECTRICAL CONNECTOR

(71) Applicant: Sumitomo Wiring Systems, Ltd., Mie (JP)

(72) Inventor: Koji Shinoda, Mie (JP)

(73) Assignee: Sumitomo Wiring Systems, Ltd.

( * ) Notice: Subject to any disclaimer, the term of this patent is extended or adjusted under 35 U.S.C. 154(b) by 33 days.

(21) Appl. No.: 16/575,728

(22) Filed: Sep. 19, 2019

(65) Prior Publication Data

US 2020/0106206 A1 Apr. 2, 2020

(30) Foreign Application Priority Data

Sep. 28, 2018 (JP) ..... JP2018-183644

(51) Int. Cl.

| | |
|---|---|
| ***H01R 13/514*** | (2006.01) |
| ***H01R 12/71*** | (2011.01) |
| ***H01R 12/55*** | (2011.01) |
| ***H01R 43/24*** | (2006.01) |
| ***H01R 13/518*** | (2006.01) |

(52) U.S. Cl.

CPC ..... *H01R 13/514* (2013.01); *H01R 12/55* (2013.01); *H01R 12/712* (2013.01); *H01R 13/518* (2013.01); *H01R 43/24* (2013.01)

(58) Field of Classification Search

CPC .... H01R 12/55; H01R 12/712; H01R 13/514; H01R 13/518; H01R 43/24

See application file for complete search history.

(56) References Cited

FOREIGN PATENT DOCUMENTS

| | | | |
|---|---|---|---|
| CN | 207800955 U | * | 8/2018 |
| JP | 6275603 | | 2/2018 |

* cited by examiner

*Primary Examiner* — Briggitte R. Hammond
(74) *Attorney, Agent, or Firm* — Gerald E. Hespos; Michael J. Porco; Matthew T. Hespos

(57) ABSTRACT

A connector (10) includes a first terminal (62) and a second terminal (32), and a first holding portion (72) and a second holding portion (42) configured to coat around the first terminal (62) and the second terminal (32) with resin. The first holding portion (72) and the second holding portion (42) are stacked one over the other in the height direction. The first terminal (62) has an exposed surface (62H) exposed on a resin surface of the first holding portion (72). The second holding portion (42) covers the exposed surface (62H) of the first terminal (62) while being stacked on or below the first holding portion (72).

4 Claims, 12 Drawing Sheets

ELECTRICAL CONNECTOR

BACKGROUND

Field of the Invention

The invention relates to a connector.

Related Art

Japanese Patent No. 6275603 discloses a connector with a connector housing having a hollow portion and terminal blocks for holding terminals. The terminal blocks are fit into the holding portion of the connector housing while being stacked one over another. Each terminal block includes terminals and an insulating member integrally formed with the terminals. Press-fit holes penetrate front and back surfaces of the insulating member along an extending direction. The terminals are press-fit respectively into the press-fit holes and are supported by the insulating member.

The connector of Japanese Patent No. 6275603 is configured such that each terminal is coated around by the insulating member and creepage distances between the terminals in a height direction of the terminal block are ensured. However, the terminal blocks are stacked one over another in this connector. Thus, the insulating members are interposed between the terminals between adjacent terminal blocks. Thus, the connector is enlarged in the height direction of the terminal blocks. To address with this problem, the connector is required to ensure creepage distances between the terminals in the height direction of the terminal blocks and to have a configuration capable of a height reduction.

The invention was completed on the basis of the above situation and aims to provide a configuration capable of a height reduction while ensuring a creepage distance between terminals in a connector in which holding portions for coating around the terminals with resin are stacked in a height direction.

SUMMARY

The invention is directed to a connector with first and second terminals, and first and second holding portions configured respectively to coat around the first and second terminals with resin. The first and second holding portions are stacked one over the other in a height direction. The first terminal has an exposed surface exposed on a resin surface of the first holding portion, and the second holding portion includes a part configured to cover the exposed surface of the first terminal with the second holding portion stacked on or below the first holding portion.

This connector includes the first holding portion and the second holding portion is configured to coat around the first and second terminals with resin. The first and second holding portions are stacked one over the other in the height direction. Thus, the resin is interposed between the first terminal and the second terminal in the connector, and a creepage distance (insulation distance) between the first and second terminals can be ensured. In addition, the second holding portion includes the part configured to cover the exposed surface of the first terminal exposed on the resin surface of the first holding portion with the second holding portion stacked on or below the first holding portion. Thus, the first holding portion enables the resin of the second holding portion to be interposed between the first and second terminals without covering the exposed surface of the first terminal with resin. In this way, the connector can be reduced in height by as much as the exposed surface of the first terminal is not covered with resin. Therefore, the connector can be reduced in height with the creepage distance between the terminals ensured.

Each of the first and second terminals may include connecting portions arranged on both ends and to be connected to mating terminals. A relay portion may be arranged in a direction intersecting projecting directions of the connecting portions between the connecting portions. Each of the first and second holding portions may coat a part of the corresponding one of the first terminal and the second terminal except the connecting portions and may include a relay holding portion in a part corresponding to the relay portion. The relay portion of the first terminal may have the exposed surface. The relay holding portion of the second holding portion may include a part configured to cover the exposed surface.

Due to relationships with mating terminals, the connecting portions of each of the first and second terminals need to ensure a given interval between the terminals. Accordingly, the exposed surface is on the relay portion that is a part different from the connecting portions in the first terminal, and is covered by the relay holding portion of the second holding portion. The interval between the terminals is changed by the relay portion that is the part different from the respective connecting portions and is arranged in the direction intersecting the projecting directions of the connecting portions. Thus, a height reduction can be realized so as not to interfere with connection to the mating terminals.

Each of the first and second terminals may include a connecting portion adjacent portions that extend in the same directions as the connecting portions and located on the sides of the relay portion. The connecting portion adjacent portions are coated respectively with resin over the entire peripheries by the first and second holding portions. According to this configuration, the resin is interposed between the connecting portion adjacent portions of the respective first and second terminals in the connector, and a creepage distance (insulation distance) between the connecting portion adjacent portion is ensured.

The connector may include a terminal block unit having an uneven shape in which the first and second holding portions are connected integrally in a direction intersecting the height direction, and the first terminal is located on a bottom surface of a recess. Terminal block units may be stacked to fit in a convex-concave manner in the height direction. According to this configuration, the terminal block units each have an uneven shape in which the first and second holding portions are connected integrally in the direction intersecting the height direction and are stacked to fit in a convex-concave manner in the height direction. Thus, the connector can prevent positional deviations of the terminal block units from each other. In addition, each terminal block unit is configured such that the first terminal is located on the bottom surface of the recess and the exposed surface of the first terminal can be covered by the other terminal block unit. In this way, the connector can cover the exposed surfaces of the first terminals, utilizing the terminal block units fit in a convex-concave manner. Therefore, the connector can be reduced in height with the creepage distances between the terminals ensured while positional deviations of the terminal block units from each other are prevented.

DETAILED DESCRIPTION

Figure 1:
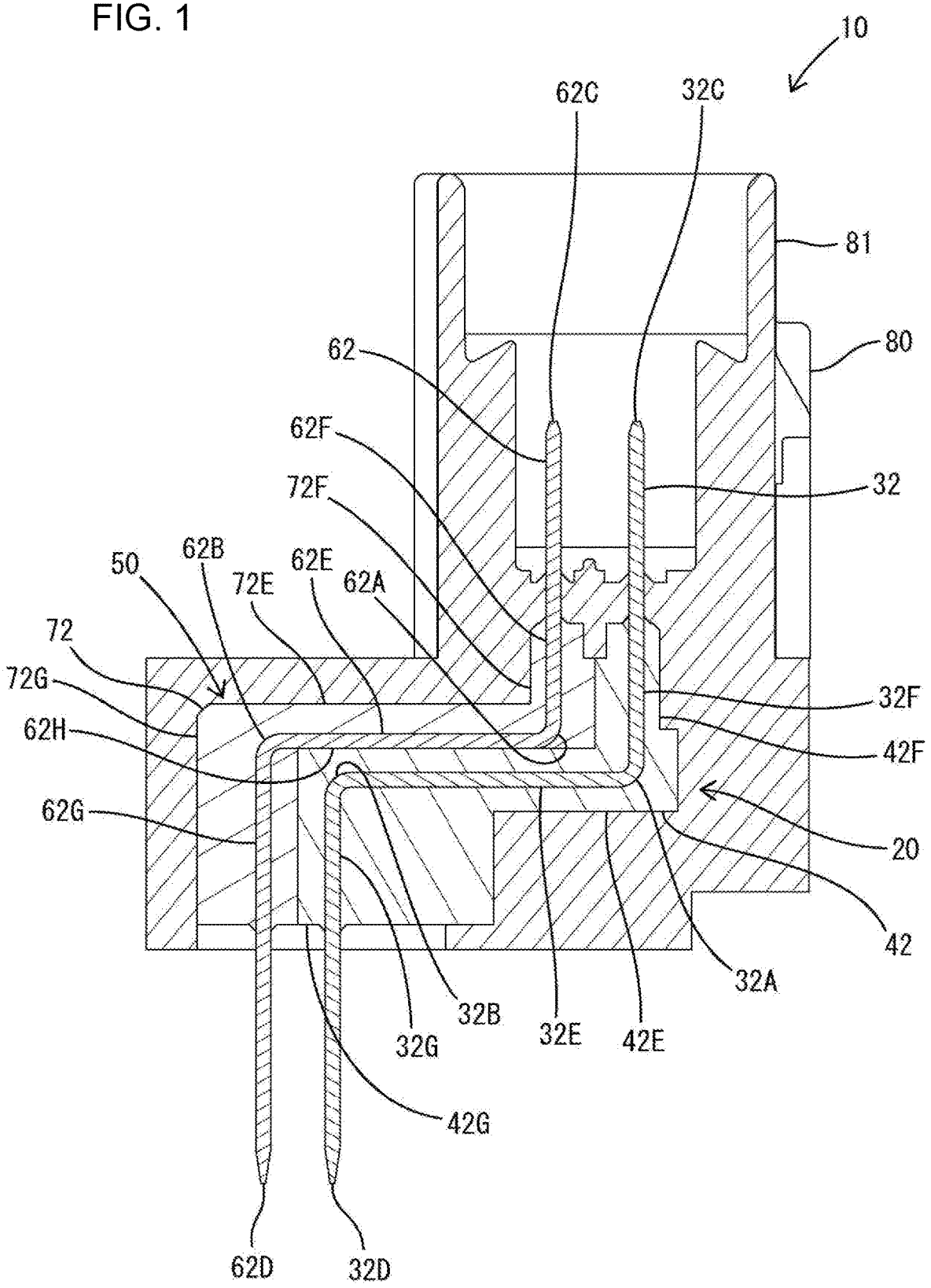
FIG. 1 is a front view in section of a connector of an embodiment.
Figure 11:
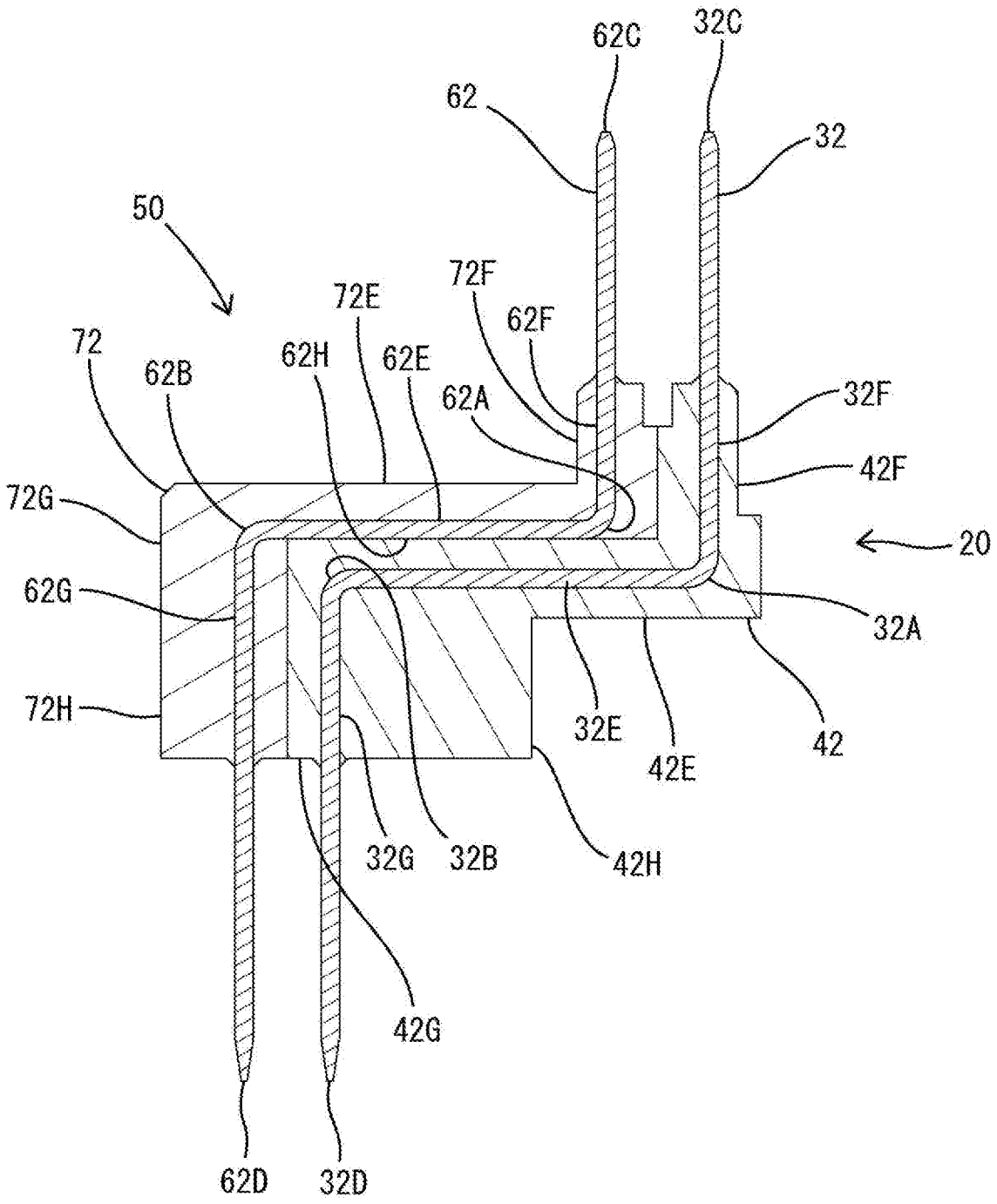
FIG. 11 is a front view in section along A-A of FIG. 7.

An embodiment of the invention is described with reference to FIGS. 1 to 13. Note that, in the following description, sides in front of and behind the plane of each of FIGS. 1, 5 and 11 are defined as a front side and a back side concerning a front-rear direction (referred to as a width direction). Upper and lower sides shown in FIGS. 1, 2, 5 to 8, 11, 12 and 13 are directly defined as upper and lower sides concerning a vertical direction (referred to as a height direction). Left and right sides shown in FIGS. 1, 5 and 9 to 11 are directly defined as left and right sides concerning a lateral direction.

Figure 2:
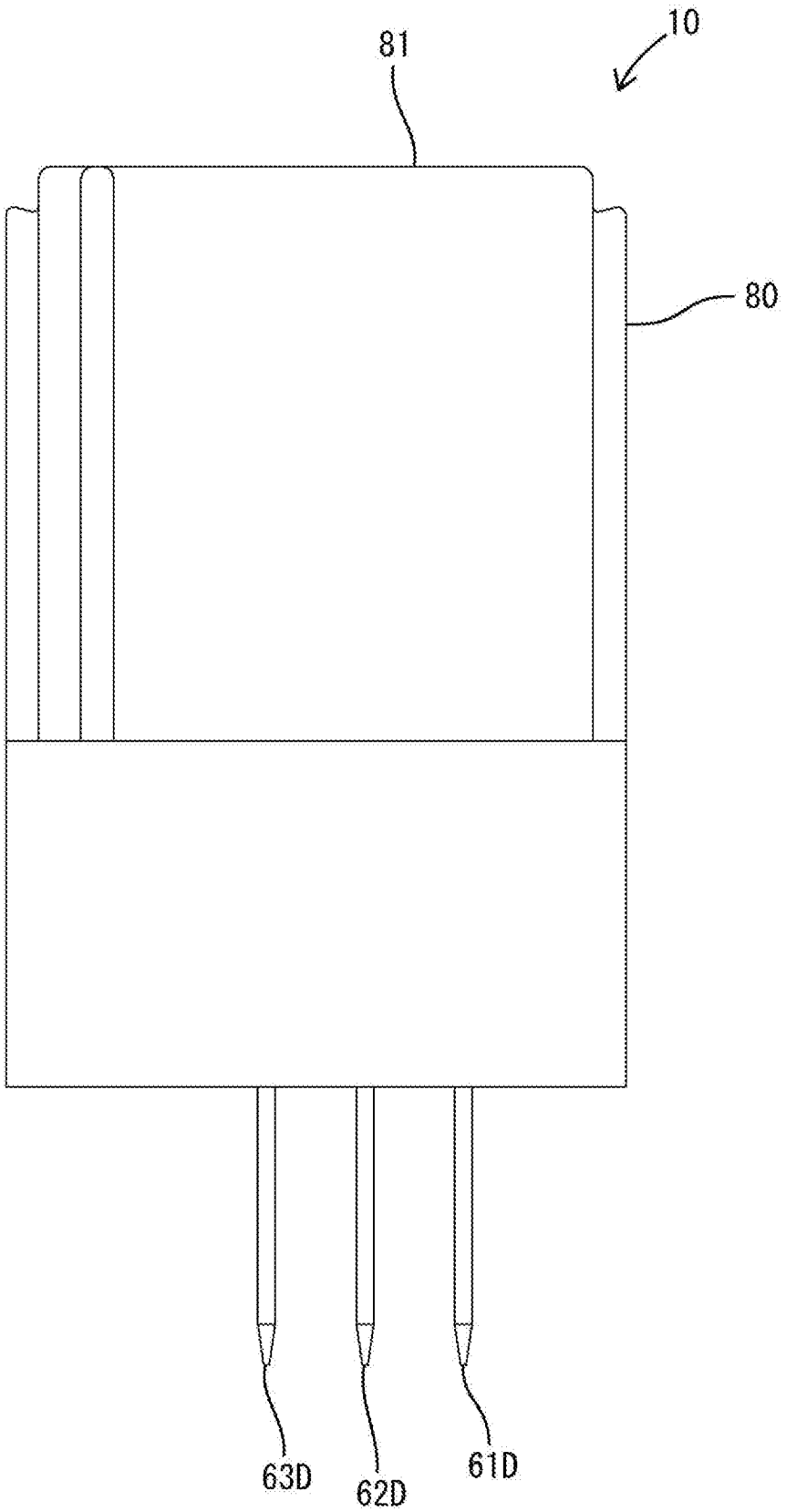
FIG. 2 is a left side view of the connector.

A connector 10 of this embodiment includes lower and upper terminal block units 20 and 50 and a housing 80, as shown in FIGS. 1 and 2. The lower and upper terminal block units 20 and 50 are stacked one over the other in the height direction. Specifically, the connector 10 is configured so that the lower terminal block unit 20 is located on a lower side in the height direction and the upper terminal block unit 50 is located on the upper side in the height direction. The housing 80 is molded with the lower and upper terminal block units 20 and 50 stacked one over the other inserted.

Figure 3:
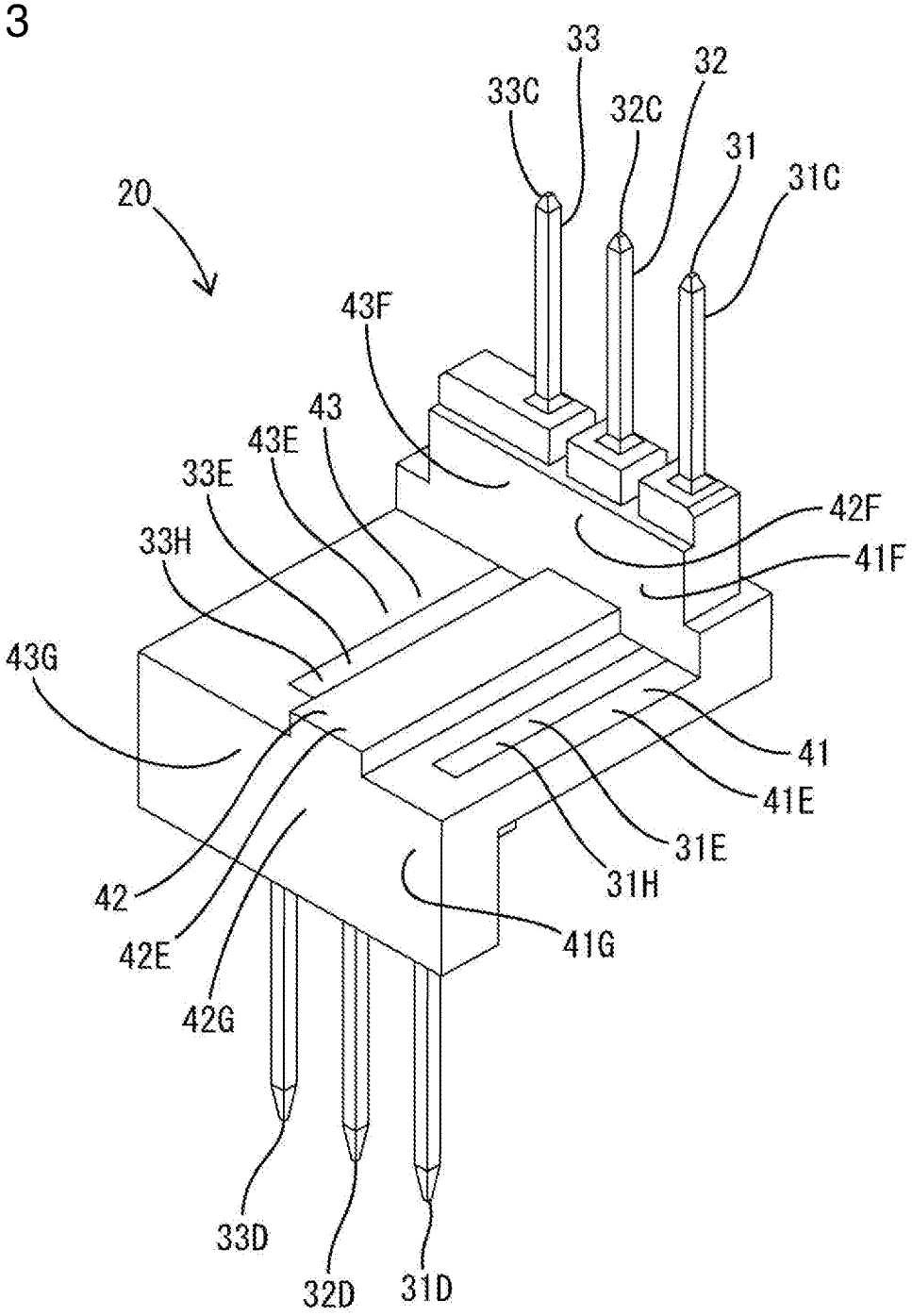
FIG. 3 is a perspective view of a one-side terminal block unit.

As shown in FIG. 3, the lower terminal block unit 20 includes first terminals 31, 33, a second terminal 32, first holding portions 41, 43 and a second holding portion 42. Note that the first terminals 31, 33 and the second terminal 32 have the same form.

As shown in FIG. 5, the first terminal 31 is a rectangular pin made of conductive metal and elongated from upper end of FIG. 5 to the lower end of FIG. 5. The first terminal 31 is formed into a crank shape by bending a straight cut wire. The first terminal 31 includes bent portions 31A, 31B, connecting portions 31C, 31D, a relay portion 31E and adjacent portions 31F, 31G The bent portions 31A, 31B are provided at two positions of the first terminal 31. The bent portions 31A, 31B are bent at a right angle. The connecting portions 31C, 31D are provided respectively on end parts (one end and the other end) of the first terminal 31, and connected to mating terminals (not shown). The connecting portion 31C extends up in the height direction. The connecting portion 31D extends down in the height direction to extend toward a side opposite to the connecting portion 31C. The relay portion 31E is arranged along a lateral direction intersecting projecting directions of the connecting portions 31C, 31D between the connecting portions 31C, 31D (more specifically, between the bent portions 31A, 31B). As shown in FIG. 3, the relay portion 31E has an exposed surface 31H exposed upward on a resin surface of the first holding portion 41 to be described later. The exposed surface 31H is the upper surface of the relay portion 31E and has a rectangular shape. The adjacent portions 31F, 31G respectively extend in the same directions as the connecting portions 31C, 31D in the first terminal 31 and are located on the sides of the relay portion 31E (respectively between the connecting portions 31C, 31D and the relay portion 31E).

As shown in FIG. 11, the second terminal 32 has bent portions 32A, 32B, connecting portions 32C, 32D, a relay portion 32E and adjacent portions 32F, 32G respectively having the same forms as the bent portions 31A, 31B, the connecting portions 31C, 31D, the relay portion 31E and the adjacent portions 31F, 31G of the first terminal 31. Note that, unlike the relay portion 31E, the relay portion 32E is coated with resin over the entire periphery by the second holding portion 42 to be described later.

Figure 6:
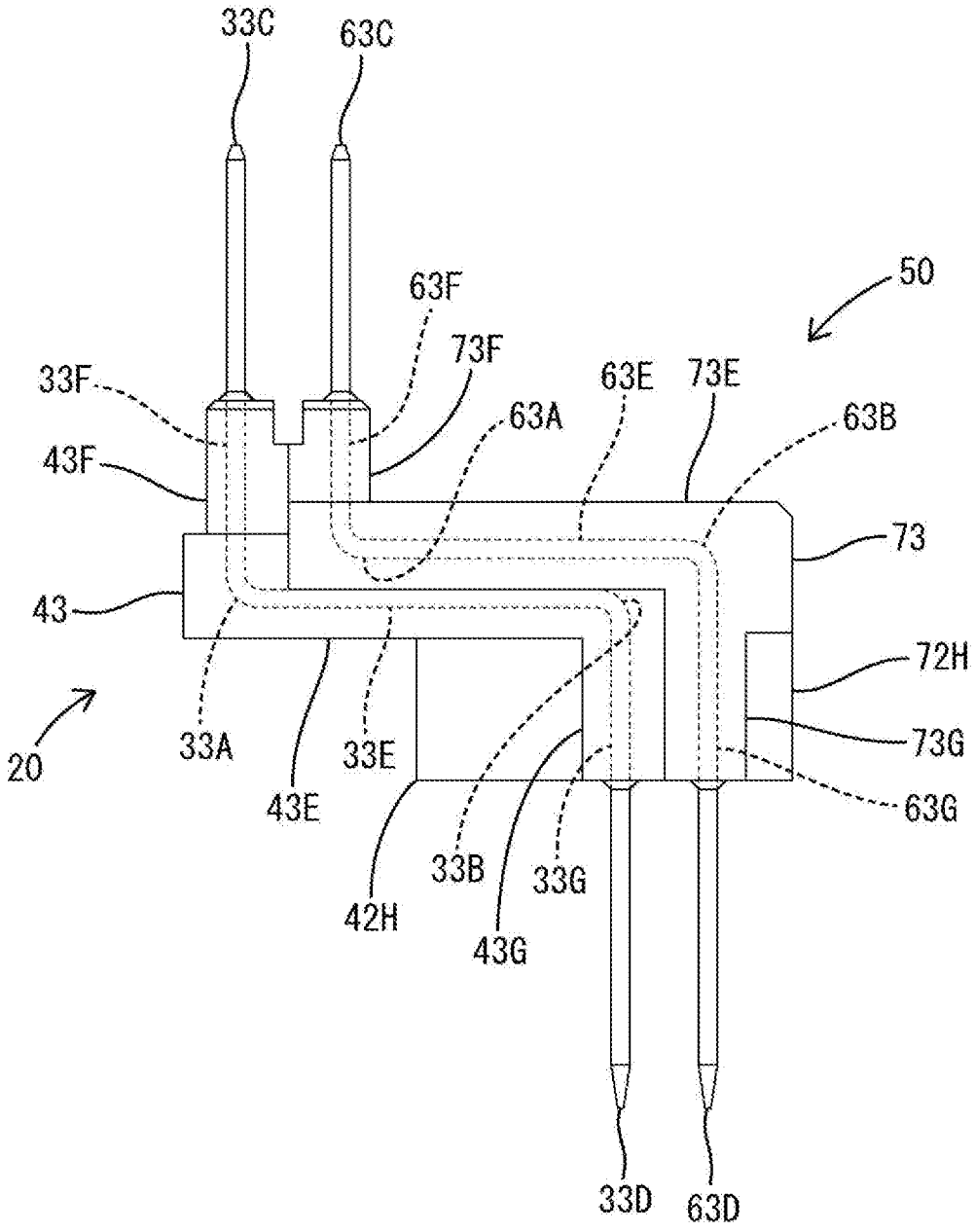
FIG. 6 is a back view showing the stacked state of the one-side terminal block unit and the other-side terminal block unit.

As shown in FIG. 6, the first terminal 33 has bent portions 33A, 33B, connecting portions 33C, 33D, a relay portion 33E and adjacent portions 33F, 33G respectively having the same forms as the bent portions 31A, 31B, the connecting portions 31C, 31D, the relay portion 31E and the adjacent portions 31F, 31G of the first terminal 31. As shown in FIG. 3, the relay portion 33E has an exposed surface 33H exposed upward on a resin surface of the first holding portion 43 to be described later. The exposed surface 33H is the upper surface of the relay portion 33E and has a rectangular shape.

As shown in FIG. 3, the first holding portions 41, 43 and the second holding portion 42 respectively coat around the first terminals 31, 33 and the second terminal 32 with resin. The first holding portions 41, 43 and the second holding portion 42 are resin-molded with the first terminals 31, 33 and the second terminal 32 as inserts (primary insert molding). Specifically, the first holding portion 41 coats a part of the first terminal 31 except the connecting portions 31C, 31D. The second holding portion 42 coats a part of the second terminal 32 except the connecting portions 32D, 32D. The first holding portion 43 coats a part of the first terminal 33 except the connecting portions 33C, 33D. The first holding portions 41, 43 and the second holding portion 42 are described in detail below.

As shown in FIGS. 3 and 5, the first holding portion 41 includes a relay holding portion 41E and adjacent holding portions 41F, 41G. The relay holding portion 41E is provided in a part corresponding to the relay portion 31E of the first terminal 31. The relay holding portion 41E has a substantially rectangular parallelepiped shape extending along a longitudinal direction of the relay portion 31E, and holds the relay portion 31E to coat the front, back and lower surfaces of the relay portion 31E with resin. The relay holding portion 41E exposes the upper surface (exposed surface 31H) of the relay portion 31E of the first terminal 31. The upper surface of the relay holding portion 41E is flush with the upper surface of the relay portion 31E. As shown in FIGS. 3 and 5, each of the adjacent holding portions 41F, 41G has a substantially rectangular parallelepiped shape extending along a longitudinal direction of the adjacent portion 31F, 31G, and coats the connecting portion adjacent portion 31F, 31G with resin over the entire periphery. The first holding portion 41 is formed such that the right and left ends of the relay holding portion 41E are connected to the lower end of the adjacent holding portion 41F and the upper end of the adjacent portion holding portion 41G as shown in FIGS. 3 and 5, and is crank-shaped in a front view as shown in FIG. 5.

As shown in FIGS. 3 and 11, the second holding portion 42 includes a relay holding portion 42E, adjacent portion holding portions 42F, 42G and a rib 42H. The relay holding portion 42E is provided in a part corresponding to the relay portion 32E of the second terminal 32 as shown in FIG. 11. The relay holding portion 42E has a substantially rectangular parallelepiped shape extending along a longitudinal direction of the relay portion 32E, and holds the relay portion 32E to coat the relay portion 32E with resin over the entire periphery. Each adjacent holding portion 42F, 42G has a substantially rectangular parallelepiped shape extending along a longitudinal direction of the adjacent portion 32F, 32G, and coats the adjacent portion 32F, 32G with resin over the entire periphery. The second holding portion 42 is formed such that the right and left ends of the relay holding portion 42E are connected respectively to the lower end of the adjacent portion holding portion 42F and the upper end of the holding portion 42G, as shown in FIGS. 3 and 11, and is crank-shaped in a front view, as shown in FIG. 11. As shown in FIGS. 8 and 10 to 12, the rib 42H is a rectangular plate extends from the lower surface of the relay holding portion 42E and the right side surface of the adjacent portion 32G The rib 42H is connected to a part of the relay holding portion 42E to the left of a center in the lateral direction. The lower end of the rib 42H is at the same height as that of the adjacent portion 32G.

As shown in FIGS. 3 and 6, the first holding portion 43 includes a relay holding portion 43E and adjacent holding portions 43F, 43G The relay holding portion 43E is in a part corresponding to the relay portion 33E of the first terminal 33. The relay holding portion 43E has a substantially rectangular parallelepiped shape extending along a longitudinal direction of the relay portion 33E, and holds the relay portion 33E to coat the front, back and lower surfaces of the relay portion 33E with resin. The relay holding portion 43E exposes the upper surface (exposed surface 33H) of the relay portion 33E of the first terminal 33. The upper surface of the relay holding portion 43E is flush with the upper surface of the relay portion 33E. As shown in FIGS. 3 and 6, each of the adjacent holding portions 43F, 43G has a substantially rectangular parallelepiped shape extending along a longitudinal direction of the adjacent portion 33F, 33G, and coats the connecting portion adjacent portion 33F, 33G with resin over the entire periphery. The first holding portion 43 is formed such that right and left ends of the relay holding portion 43E are connected respectively to the lower end of the adjacent portion holding portion 43F and the upper end of the adjacent portion holding portion 43G as shown in FIGS. 3 and 6, and is crank-shaped in a back view as shown in FIG. 6.

Figure 8:
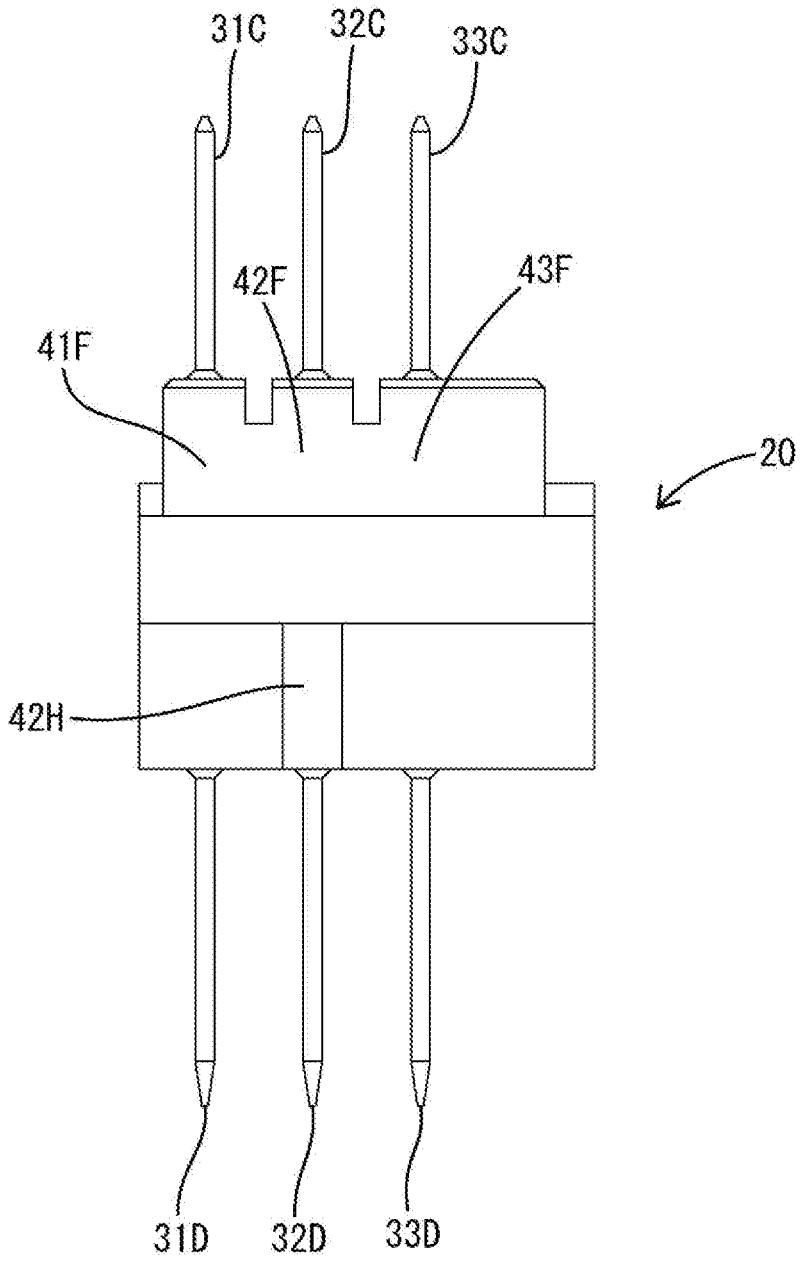
FIG. 8 is a right side view showing the stacked state of the one-side terminal block unit and the other-side terminal block unit.
Figure 9:
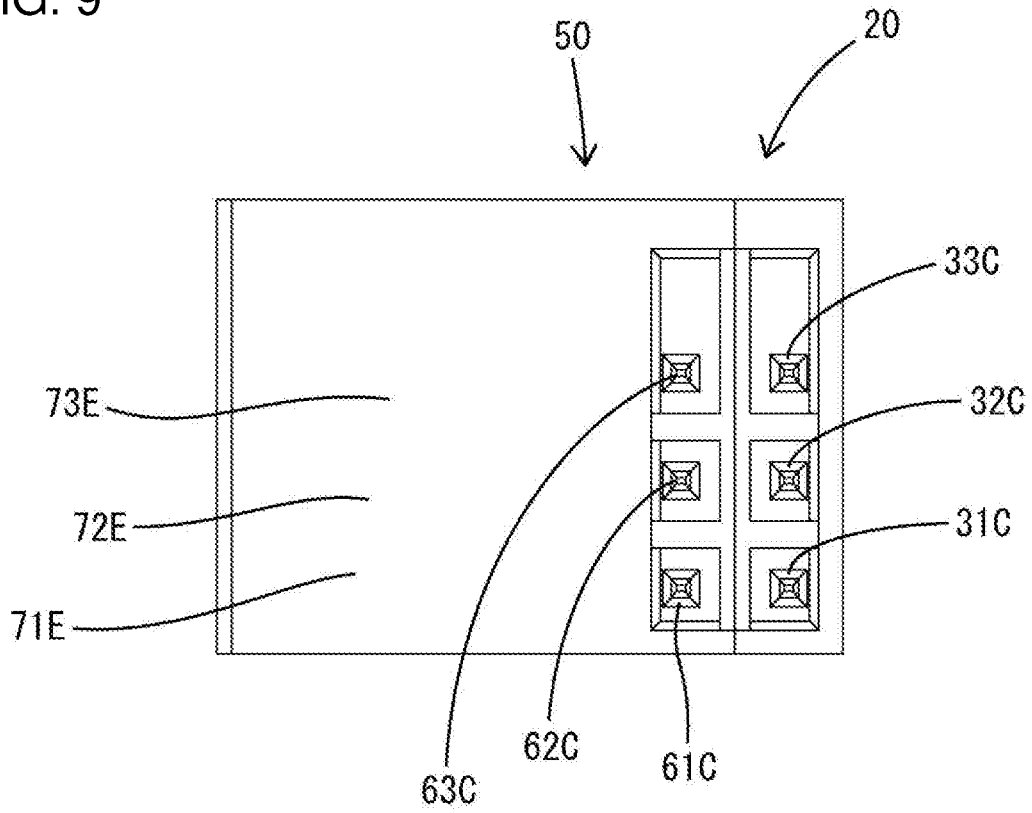
FIG. 9 is a plan view showing the stacked state of the one-side terminal block unit and the other-side terminal block unit.
Figure 10:
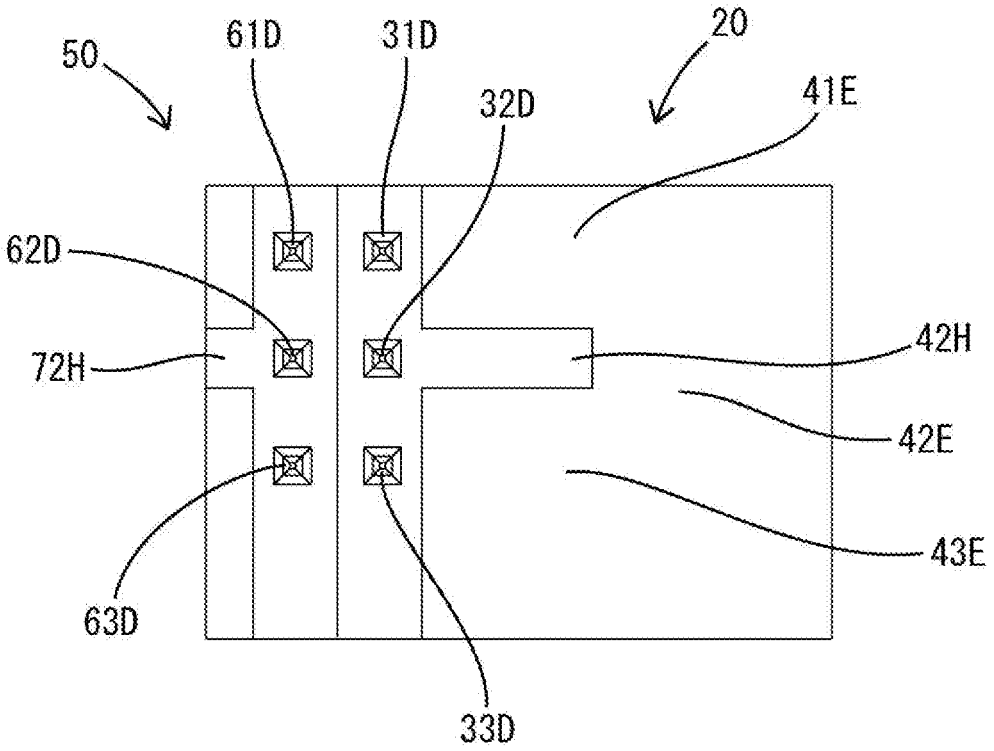
FIG. 10 is a bottom view showing the stacked state of the one-side terminal block unit and the other-side terminal block unit.
Figure 12:
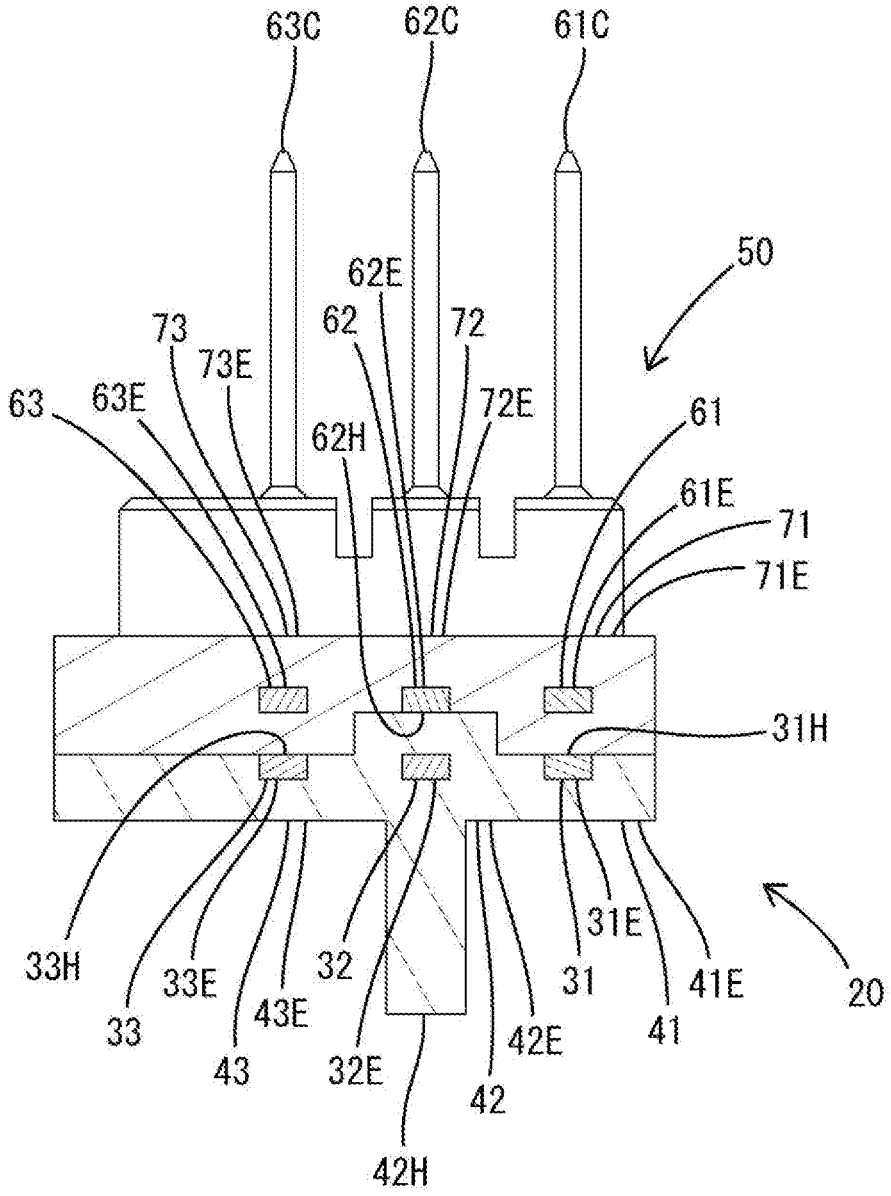
FIG. 12 is a left side view in section along B-B of FIG. 5.

As shown in FIGS. 8 and 12, the first holding portions 41, 43 and the second holding portion 42 are connected integrally in the width direction (front-rear direction). Specifically, the first holding portion 41, the second holding portion 42 and the first holding portion 43 are arranged from front to rear in this order. Further, the first holding portion 41, the second holding portion 42 and the first holding portion 43 are connected so that the respective terminals 31 to 33 are at the same heights. Thus, the first holding portions 41, 43 are recessed down with respect to the second holding portion 42 since the relay portions 31E, 33E of the first terminals 31, 33 are not covered from above. In this way, the lower terminal block unit 20 has an uneven upper surface and the first terminals 31, 33 are located on the bottom surfaces of recesses (respective upper surfaces of the relay holding portions 41E, 43E).

Figure 4:
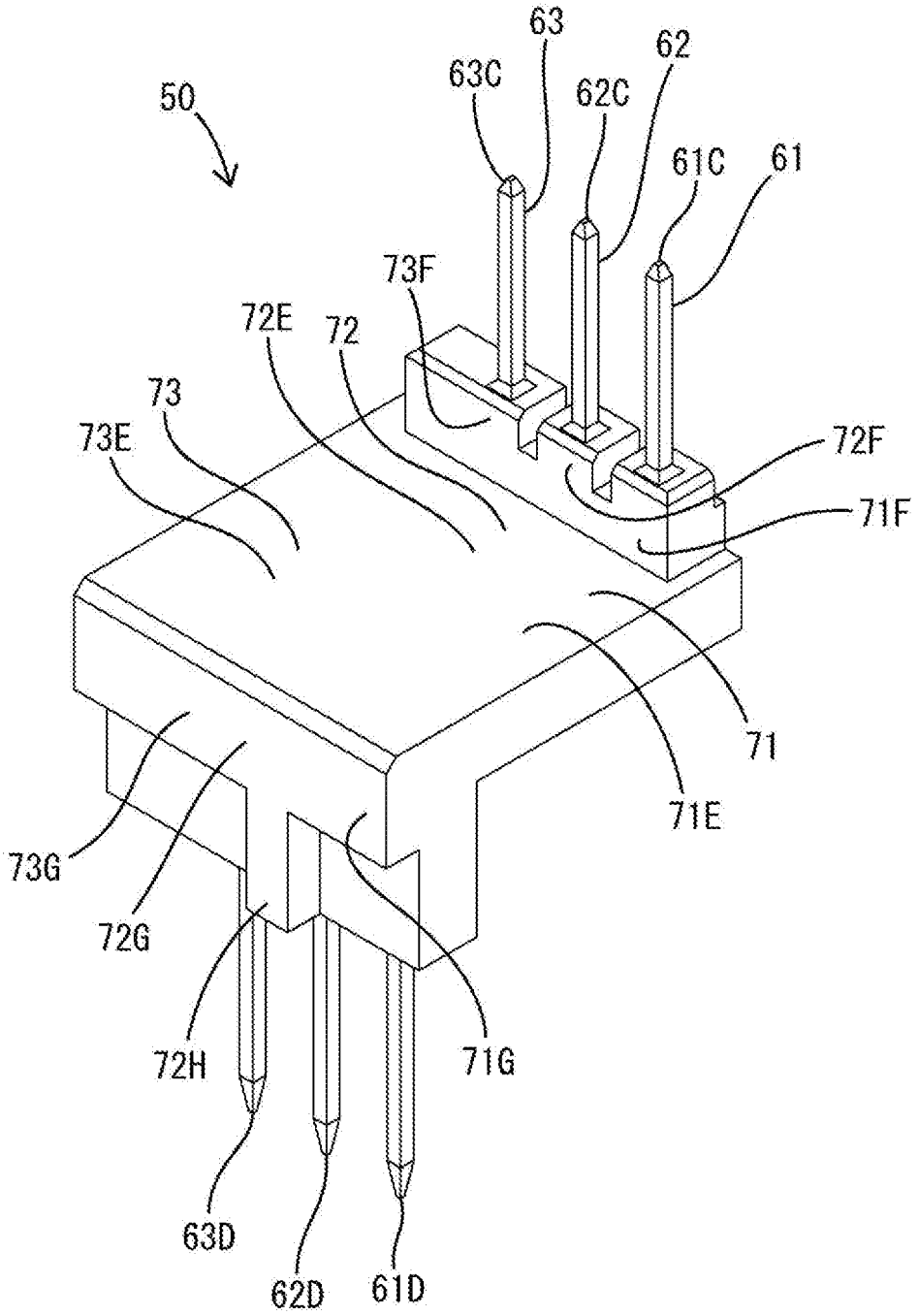
FIG. 4 is a perspective view of an other-side terminal block unit.
Figure 5:
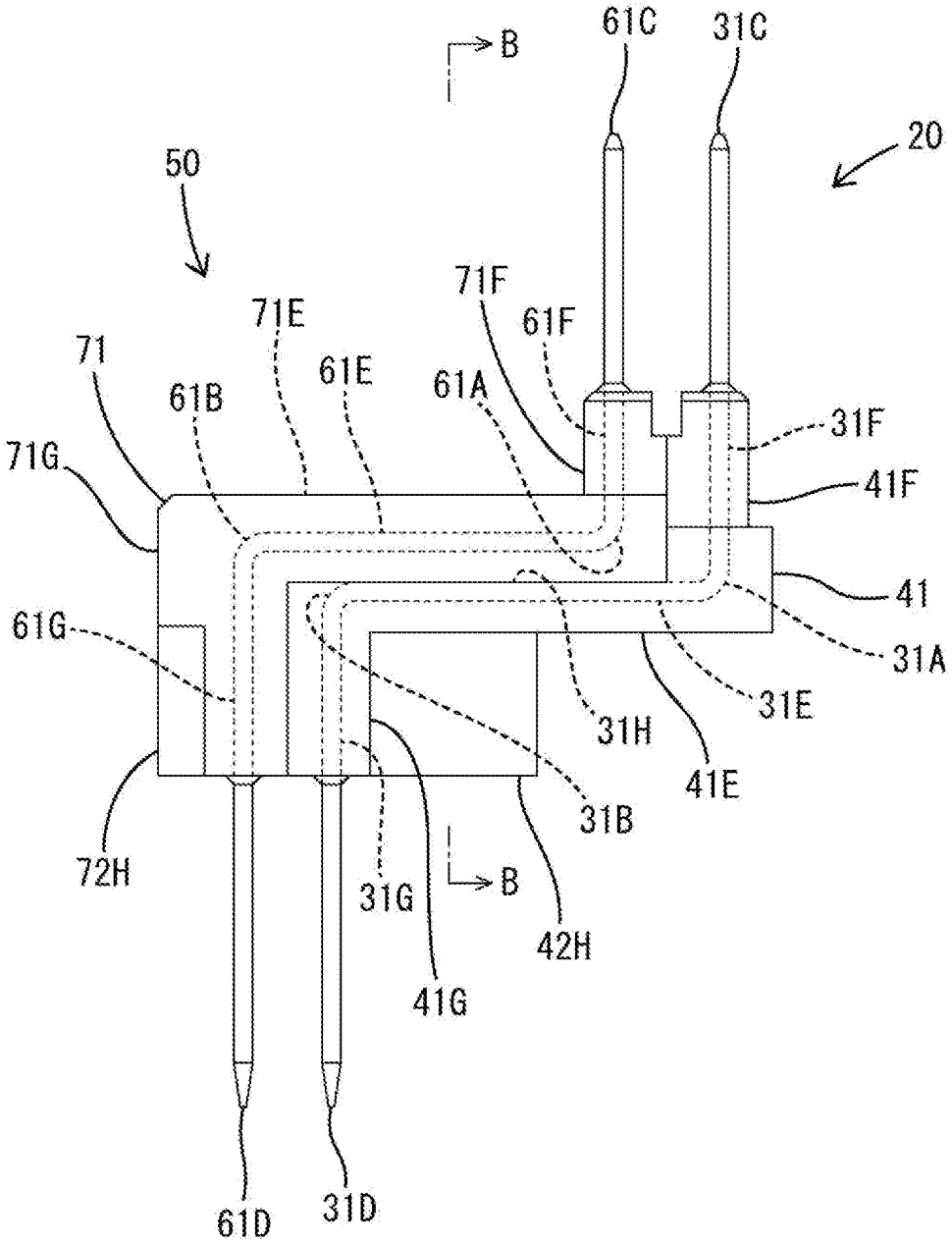
FIG. 5 is a front view showing a stacked state of the one-side terminal block unit and the other-side terminal block unit.

As shown in FIG. 4, the upper terminal block unit 50 includes a first terminal 62, second terminals 61, 63, a first holding portion 72 and second holding portions 71, 73. Note that the first terminal 62 and the second terminals 61, 63 have the same form as the first terminal 31 described above and are not described in detail.

As shown in FIG. 5, the second terminal 61 includes bent portions 61A, 61B, connecting portions 61C, 61D, a relay portion 61E and adjacent portions 61F, 61G respectively having the same forms as the bent portions 31A, 31B, the connecting portions 31C, 31D, the relay portion 31E and the adjacent portions 31F, 31G of the first terminal 31 described above.

As shown in FIG. 11, the first terminal 62 includes bent portions 62A, 62B, connecting portions 62C, 62D, a relay portion 62E and adjacent portions 62F, 62G respectively having the same forms as the bent portions 31A, 31B, the connecting portions 31C, 31D, the relay portion 31E and the adjacent portions 31F, 31G of the first terminal 31 described above. As shown in FIGS. 11 and 12, the relay portion 62E has an exposed surface 62H exposed downward on a resin surface of the first holding portion 72 to be described later. The exposed surface 62H is the lower surface of the relay portion 62E and has a rectangular shape.

As shown in FIG. 6, the second terminal 63 includes bent portions 63A, 63B, connecting portions 63C, 63D, a relay portion 63E and connecting portion adjacent portions 63F, 63G respectively having the same forms as the bent portions 31A, 31B, the connecting portions 31C, 31D, the relay portion 31E and the connecting portion adjacent portions 31F, 31G of the first terminal 31 described above.

As shown in FIG. 4, the second holding portions 71, 73 and the first holding portion 72 respectively coat around the second terminals 61, 63 and the first terminal 62 with resin. The second holding portions 71, 73 and the first holding portion 72 are respectively resin-molded with the second terminals 61, 63 and the first terminal 62 as inserts (primary insert molding). Specifically, the second holding portion 71 coats a part of the second terminal 61 except the connecting portions 61C, 61D. The first holding portion 72 coats a part of the first terminal 62 except the connecting portions 62D, 62D. The second holding portion 73 coats a part of the second terminal 63 except the connecting portions 63C, 63D. The second holding portions 72, 73 and the first holding portion 71 are described in detail below.

As shown in FIGS. 4 and 5, the second holding portion 71 includes a relay holding portion 71E and adjacent portion holding portions 71F, 71G. The relay holding portion 71E is provided in a part corresponding to the relay portion 61E of the second terminal 61. The relay holding portion 71E has a substantially rectangular parallelepiped shape extending along a longitudinal direction of the relay portion 61E, and holds the relay portion 61E to coat the relay portion 61E with resin over the entire periphery. The adjacent holding portion 71E has a substantially rectangular parallelepiped shape extending along a longitudinal direction of the adjacent portion 61F and coats the adjacent portion 61F with resin over the entire periphery. The adjacent holding portion 71G has a substantially rectangular parallelepiped shape extending along a longitudinal direction of the connecting portion adjacent portion 61G and coats the adjacent portion 61G with resin over the entire periphery. The second holding portion 71 is formed such that the right and left ends of the relay holding portion 71E are connected respectively to the lower end of the adjacent portion holding portion 71F and the upper end of the adjacent portion holding portion 71G and is crank-shaped in a front view as shown in FIG. 5.

As shown in FIGS. 4 and 11, the first holding portion 72 includes a relay holding portion 72E, adjacent portion holding portions 72F, 72G and a rib 72H. The relay holding portion 72E is provided in a part corresponding to the relay portion 62E of the first terminal 62. The relay holding portion 72E has a substantially rectangular parallelepiped shape extending along a longitudinal direction of the relay portion 62E, and holds the relay portion 62E to coat the front, back and lower surfaces of the relay portion 62E with resin. The relay holding portion 72E exposes the lower surface (exposed surface 62H) of the relay portion 62E of the first terminal 62. The lower surface of the relay holding portion 72E is flush with the lower surface of the relay portion 62E. The adjacent portion holding portion 72E has a substantially rectangular parallelepiped shape extending along a longitudinal direction of the connecting portion adjacent portion 62F and coats the connecting portion adjacent portion 62F with resin over the entire periphery. The adjacent portion holding portion 72G has a substantially rectangular parallelepiped shape extending along a longitudinal direction of the connecting portion adjacent portion 62G and coats the connecting portion adjacent portion 62G with resin over the entire periphery. The first holding portion 72 is formed such that the right and left ends of the relay holding portion 72E are respectively connected to the lower end of the adjacent portion holding portion 72F and the upper end of the adjacent portion holding portion 72G as shown in FIGS. 4 and 11, and is crank-shaped in a front view as shown in FIG. 11. As shown in FIGS. 4 to 7, the rib 72H is a projecting piece having a rectangular shape in a front view and formed in a left recessed part of the adjacent portion holding portion 72G. The lower end of the rib 72H is located at the same height as that of the adjacent portion holding portion 72G, and the left end thereof is located at the same position as that of the adjacent portion holding portion 72G in the lateral direction.

As shown in FIGS. 4 and 6, the second holding portion 73 includes a relay holding portion 73E and adjacent portion holding portions 73F, 73G The relay holding portion 73E is provided in a part corresponding to the relay portion 63E of the second terminal 63. The relay holding portion 73E has a substantially rectangular parallelepiped shape extending along a longitudinal direction of the relay portion 63E, and holds the relay portion 63E to coat the relay portion 63E with resin over the entire periphery. The adjacent portion holding portion 73F has a substantially rectangular parallelepiped shape extending along a longitudinal direction of the connecting portion adjacent portion 63F and coats the connecting portion adjacent portion 63F with resin over the entire periphery. The adjacent portion holding portion 73G has a substantially rectangular parallelepiped shape extending along a longitudinal direction of the connecting portion adjacent portion 63G and coats the connecting portion adjacent portion 63G with resin over the entire periphery. The second holding portion 73 is formed such that the right and left ends of the relay holding portion 73E are respectively connected to the lower end of the adjacent portion holding portion 73F and the upper end of the adjacent portion holding portion 73Q and is crank-shaped in a back view as shown in FIG. 6.

Figure 7:
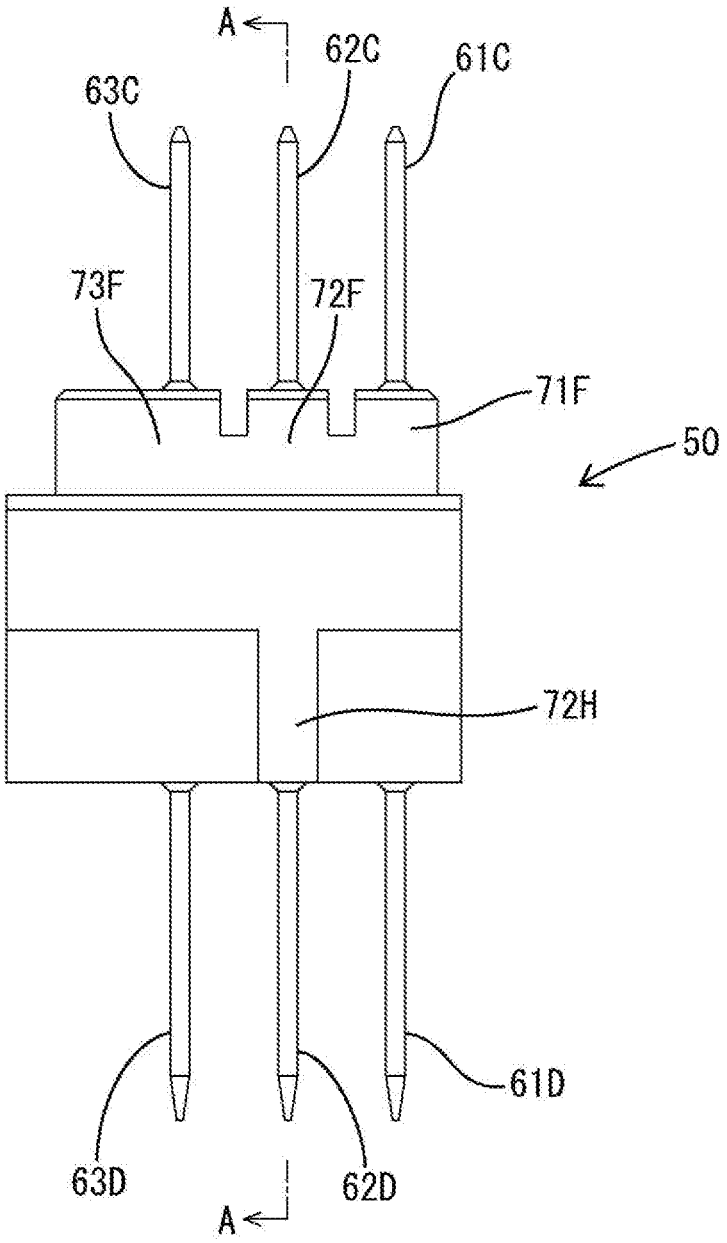
FIG. 7 is a left side view showing the stacked state of the one-side terminal block unit and the other-side terminal block unit.

As shown in FIGS. 7 and 12, the second holding portions 71, 73 and the first holding portion 72 are integrally connected in the width direction (front-rear direction). Specifically, the second holding portion 71, the first holding portion 72 and the second holding portion 73 are arranged from front to rear in this order. Further, the second holding portion 71, the first holding portion 72 and the second holding portion 73 are so connected that the respective terminals 61, 62 and 63 are at the same positions (heights) in the vertical direction. Thus, the first holding portion 72 is recessed upwardly with respect to the second holding portions 71, 73 since the relay portion 62E of the first terminal 62 is not covered from above. In this way, the other-side terminal block unit 50 has an uneven lower surface and the first terminal 62 is located on the bottom surface of a recess (lower surface of the relay holding portion 72E).

The lower terminal block unit 20 and the upper terminal block unit 50 configured as described above are stacked in the height direction such that the upper terminal block unit 50 covers the lower terminal block unit 20 from above as shown in FIGS. 5 to 12. The lower terminal block unit 20 and the upper terminal block unit 50 are fit in a convex-concave manner in the height direction. Specifically, as shown in FIG. 12, the upper end of the second holding portion 42 is fit between the second holding portions 71 and 73. The upper surfaces of the respective holding portions 41 to 43 of the lower terminal block unit 20 are respectively in contact with the lower surfaces of the respective holding portions 71 to 73 of the upper terminal block unit 50. By fitting the lower terminal block unit 20 and the upper terminal block unit 50 in a convex-concave manner in this way, positional deviations of the respective terminal block units 20, 50 from each other can be prevented. The second holding portions 71, 73 of the upper terminal block unit 50 respectively cover the exposed surfaces 31H, 33H of the first terminals 31, 33 of the lower terminal block unit 20 from above. The second holding portion 42 of the lower terminal block unit 20 covers the exposed surface 62H of the first terminal 62 of the upper terminal block unit 50 from below.

Given intervals are maintained between the respective terminals 31 to 33 of the lower terminal block unit 20 and the respective terminals 61 to 63 of the upper terminal block unit 50, and the resin is interposed between these terminals. Thus, creepage distances (insulation distances) between the respective terminals 31 to 33 and the respective terminals 61 to 63 are reliably ensured. In addition, the second holding portions 71, 73 and 42 respectively cover the exposed surfaces 31H, 33H and 62H of the first terminals 31, 33 and 62 exposed on the resin surfaces of the first holding portions 41, 43 and 72. Thus, the first holding portion 41, 43, 72 enables the resin of the second holding portion 71, 73, 42 to be interposed between the second terminal 61, 63, 32 and the first terminal 31, 33, 62 without covering the exposed surface 31H, 33H, 62H with resin. In this way, the connector 10 can be reduced in height by as much as the exposed surfaces 31H, 33H and 62H are not covered with resin. Therefore, the connector 11 can be reduced in height with the creepage distances between the terminals in the height direction ensured.

Figure 13:
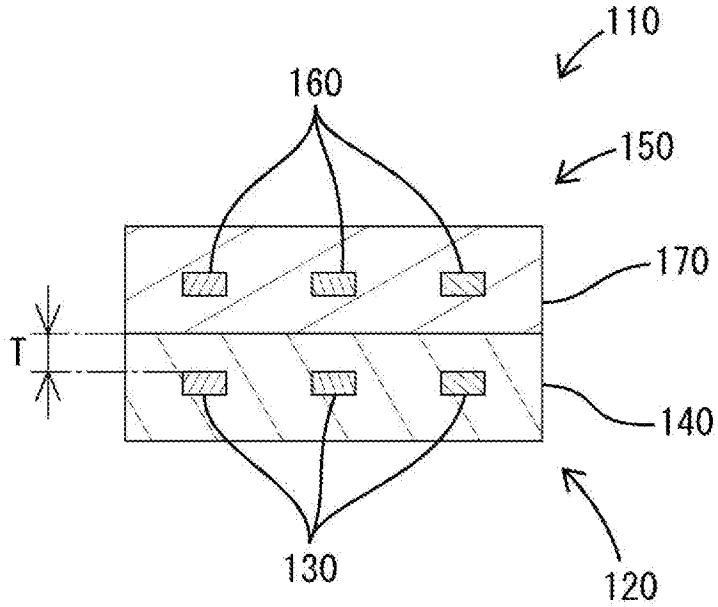
FIG. 13 is a left side view in section schematically showing a cross-section of a stacked part of a conventional connector.

For example, in a conventional connector 110, a lower terminal block unit 120 coats all terminals 130 with resin over the entire peripheries by a holding portion 140 in a stacked part as shown in FIG. 13. Similarly, an upper terminal block unit 150 coats all terminals 160 with resin over the entire peripheries by a holding portion 170 in the stacked part. Thus, in the connector 110, coating parts of the respective holding portions 140, 170 are interposed between the terminals 130 and the terminals 160 in the height direction, wherefore a height reduction has been difficult. However, in this embodiment, the upper surface of the lower terminal block unit 20 and the lower surface of the upper terminal block unit 50 are formed into uneven shapes to expose some of the terminals and fit in a convex-concave manner, whereby the height can be reduced by as much as the terminals are not coated with resin (by a thickness denoted by T in FIG. 13).

By fitting the lower terminal block unit 20 and the upper terminal block unit 50 in a convex-concave manner, intervals between the relay portions 31E to 33E and the relay portions 61E to 63E become narrower. However, since the connecting portions 31C to 33C, 61C to 63C extend in directions intersecting the relay portions 31E to 33E, 61E to 63E, a change in the intervals between the relay portions does not affect the intervals between the connecting portions. In this way, the height of the connector 10 can be so reduced as not to interfere with connection to the mating terminals.

Further, as shown in FIG. 5, the adjacent portion holding portions 41F, 41G respectively overlap with the adjacent portion holding portions 71F, 71G in the lateral direction. As shown in FIG. 11, the adjacent portion holding portions 42F, 42G respectively overlap with the adjacent portion holding portions 72F, 72G in the lateral direction. A shown in FIG. 6, the adjacent portion holding portions 43F, 43G respectively overlap with the adjacent portion holding portions 73F, 73G in the lateral direction. In this way, the resin is interposed between the connecting portion adjacent portions 31F to 33F, 31G to 33G and the connecting portion adjacent portions 61F to 63F, 61G to 63G in the connector 10, wherefore the creepage distances (insulation distances) between these connecting portion adjacent portions can be reliably ensured.

The housing 80 is resin-molded with the lower terminal block unit 20 and the upper terminal block unit 50 in the stacked state as an insert, and collectively coats around the lower terminal block unit 20 and the upper terminal block unit 50 with resin. As shown in FIG. 1, the housing 80 is bent into a crank shape as a whole to extend along the route forms of the respective terminals 31 to 33, 61 to 63. An upwardly open tubular receptacle 81 is provided on the upper end of the housing 80.

The connecting portions 31C to 33C, 61C to 63C of the respective terminals 31 to 33, 61 to 63 are arranged to project into the receptacle 81. Further, the connecting portions 31D to 33D, 61D to 63D of the receptacle terminals 31 to 33 are arranged to project downward from the lower end of the housing 80. Unillustrated mating terminals are electrically connected to the connecting portions 31C to 33C, 61C to 63C. Conductive parts or the like (mating terminals) of an unillustrated printed circuit board are, for example, electrically connected to the connecting portions 31D to 33D, 61D to 63D.

The connector 10 includes the first holding portions 41, 43 and 72 and the second holding portions 42, 71 and 73 that coat around the first terminals 31, 33 and 62 and the second terminals 32, 61 and 63 with resin. The first holding portions 41, 43 and 72 and the second holding portions 71, 73 and 42 are stacked one over the other in the height direction. Thus, the resin is interposed between the first terminals 31, 33 and 62 and the second terminals 61, 63 and 32 in the connector 10 so that the creepage distances (insulation distances) between the first terminals 31, 33 and 62 and the second terminals 61, 63 and 32 are ensured. In addition, the second holding portion 42, 71, 73 includes a part configured to cover the exposed surface 62H, 31H, 33H of the first terminal 62, 31, 33 exposed on the resin surface of the first holding portion 72, 41, 43 with the second holding portion 42, 71, 73 stacked on or below the first holding portion 72, 41, 43. Thus, the first holding portion 72, 41, 43 enables the resin of the second holding portion 42, 71, 73 to be interposed between the first terminal 31, 33, 62 and the second terminal 32, 61, 63 without covering the exposed surface 62H, 31H, 33H of the first terminal 62, 31, 33 with resin. In this way, the connector 10 can be reduced in height by as much as the exposed surfaces 31H, 33H and 62H of the first terminals 31, 33 and 62 are not covered with the resin. Therefore, the connector 10 can be reduced in height with creepage distances between the terminals ensured.

The relay portion 31E of the first terminal 31 has the exposed surface 31H, and the relay holding portion 71E of the second holding portion 71 covers the exposed surface 31H.

Due to relationships with the mating terminals, the both connecting portions 31C, 61C of the first terminal 31 and the second terminal 61 need to ensure a given interval between the terminals. Accordingly, the exposed surface 31H is provided on the relay portion 31E, which is a part different from the connecting portion 31C in the first terminal 31, and covered by the relay holding portion 71E of the second holding portion 71. As just described, the height of the connector 10 can be so reduced as not to interfere with connection to the mating terminals by changing the interval between the terminals by the relay portions 31E, 61E that are parts different from the respective connecting portions 31C, 61C and arranged along the height direction.

Effects brought about by relationships between the first and second terminal 31 and 61 are described above, but the relationships between the first and second terminals 62 and 32 and between the first and second terminal 33 and 63 exhibit similar effects.

Further, the first terminal 31 includes the connecting portion adjacent portions 31F, 31G extending in the same directions as the connecting portions 31C, 31D and located on the sides of the relay portion 31E, and the connecting portion adjacent portions 31F, 31G are coated with resin over the entire peripheries by the first holding portion 41. The second terminal 61 includes the connecting portion adjacent portions 61F, 61G extending in the same directions as the connecting portions 61C, 61D and located on the sides of the relay portion 61E, and the connecting portion adjacent portions 61F, 61G are coated with resin over the entire peripheries by the second holding portion 71.

According to this configuration, the resin is interposed between the connecting portion adjacent portions 31F and 61F and between the connecting portion adjacent portions 31G and 61G in the connector 10, and the creepage distances (insulation distances) between the both connecting portion adjacent portions can be reliably ensured.

Although effects brought about by the relationship between the first terminal 31 and the second terminal 61 are described above, the relationships between the first terminal 62 and the second terminal 32 and between the first terminal 33 and the second terminal 63 also exhibit similar effects.

Further, the connector 10 includes the lower terminal block unit 20 having an uneven shape in which the first holding portions 41, 43 and the second holding portion 42 are integrally connected in the width direction (front-rear direction) and the first terminals 31, 33 are located on the bottom surfaces of the recesses. The connector 10 includes the upper terminal block unit 50 having an uneven shape in which the first holding portion 72 and the second holding portions 71, 73 are integrally connected in the width direction (front-rear direction) and the first terminal 62 is located on the bottom surface of the recess. The lower terminal block unit 20 and the upper terminal block unit 50 are stacked to fit in a convex-concave manner in the height direction.

According to this configuration, the connector 10 can prevent positional deviations of the lower terminal block unit 20 and the upper terminal block unit 50 from each other. In addition, the lower terminal block unit 20 and the upper terminal block unit 50 are configured such that the first terminals 31, 33 and 62 are located on the bottom surfaces of the recesses, and the exposed surface 31H, 33H, 62H of the first terminal 31, 33, 62 can be covered by the other terminal block units. In this way, the connector 10 can cover the exposed surfaces 31H, 33H and 62H of the first terminals 31, 33 and 62, utilizing the lower terminal block unit 20 and the upper terminal block unit 50 fit in a convex-concave manner. Thus, the connector 10 can be reduced in height with the creepage distances between the terminals ensured while positional deviations of the lower terminal block unit 20 and the upper terminal block unit 50 from each other are prevented.

The present invention is not limited to the above described and illustrated embodiment. For example, the following embodiments are also included in the technical scope of the present invention.

Although the lower terminal block unit 20 has the uneven upper surface uniformly continuous in the lateral direction in the above embodiment, an uneven pattern may be reversed at an intermediate position in the lateral direction (projections may be arranged in an offset manner). For example, the upper surface of the lower terminal block unit 20 may include an area where a recess (recess where the terminal is exposed on the bottom surface), a projection (projection where the terminal is coated) and a recess are successively arranged and an area where a projection, a recess and a projection are successively arranged. In this case, the lower surface of the upper terminal block unit 50 is also formed into an uneven shape having a pattern opposite to that of the lower terminal block unit 20.

Although two recesses and one projection are formed on the upper surface of the lower terminal block unit 20 in the above embodiment, the numbers of the recess(es) and the projection(s) are not limited to these. For example, the upper surface of the lower terminal block unit 20 may have such a pattern that one recess and one projection are formed (pattern constituted by the first holding portion 41 and the second holding portion 42). Similarly, the numbers of the recess(es) and the projection(s) of the lower surface of the upper terminal block unit 50 are also not limited.

One terminal (first terminal 31, 33, 62) is exposed from each of the first holding portions 41, 43 and 72 in the above embodiment, but two or more terminals may be exposed.

Although each terminal 31 to 33, 61 to 63 of the connector 10 is crank-shaped in the above embodiment, each terminal 31 to 33, 61 to 63 may be U-shaped. Specifically, although each terminal 31 to 33, 61 to 63 is formed such that two connecting portions extend toward the opposite sides, the pair of connecting portions may extend toward the same side.

Although the bent portions 31A, 31B of the first terminal 31 are bent at a right angle in the above embodiment, the bent portions 31A, 31B may not be bent at a right angle if they intersect the vertical direction (height direction). The same applies also to the other terminals 32, 33 and 61 to 63.

In the above embodiment, the connector 10 is configured such that the lower terminal block unit 20 and the upper terminal block unit 50 are covered by the insert-molded housing 80. However, the connector 10 may be a block connector composed of the lower terminal block unit 20 and the upper terminal block unit 50 in the stacked state without performing insert molding to cover with the housing 80.

LIST OF REFERENCE SIGNS

10 . . . connector
20 . . . lower terminal block unit (terminal block unit)
31, 33, 62 . . . first terminal
31C, 31D, 32C, 32D, 33C, 33D, 61C, 61D, 62C, 62D, 63C, 63D . . . connecting portion
31E, 32E, 33E, 61E, 62E, 63E . . . relay portion
31H, 33H, 62H . . . exposed surface
32, 61, 63 . . . second terminal
31F, 31G 32F, 32G 33F, 33G 61F, 61G 62F, 62G 63F, 63G . . . adjacent portion
41, 43, 72 . . . first holding portion
41E, 42E, 43E, 71E, 72E, 73E . . . relay holding portion
42, 71, 73 . . . second holding portion
50 . . . upper terminal block unit (terminal block unit)

What is claimed is:

1. An electrical connector, comprising:
a first terminal and a second terminal; and
a first holding portion and a second holding portion configured to respectively coat around the first terminal and the second terminal with resin;
wherein:
the first holding portion and the second holding portion are stacked one over the other in a height direction;
the first terminal has an exposed surface exposed on a resin surface of the first holding portion; and
the second holding portion includes a part configured to cover the exposed surface of the first terminal with the second holding portion stacked on or below the first holding portion.

2. The electrical connector of claim 1, wherein:
each of the first terminal and the second terminal includes:
connecting portions arranged on both end sides and to be connected to mating terminals; and
a relay portion arranged in a direction intersecting projecting directions of the connecting portions between the both connecting portions;
each of the first holding portion and the second holding portion coats a part of the corresponding one of the first terminal and the second terminal except the connecting portions and includes a relay holding portion in a part corresponding to the relay portion;
the relay portion of the first terminal has the exposed surface; and
the relay holding portion of the second holding portion includes a part configured to cover the exposed surface.

3. The electrical connector of claim 2, wherein each of the first terminal and the second terminal includes adjacent portions extending in the same directions as the connecting portions and located on the sides of the relay portion, and the adjacent portions are coated respectively with resin over the entire peripheries by the first holding portion and the second holding portion.

4. The electrical connector of claim 3, comprising a terminal block unit having an uneven shape in which the first holding portion and the second holding portion are connected integrally in a direction intersecting the height direction and the first terminal is located on a bottom surface of a recess, wherein:

plural of the terminal block units are stacked to fit in a convex-concave manner in the height direction.

* * * * *